US012674360B2

(12) United States Patent
Bedouet et al.

(10) Patent No.: US 12,674,360 B2
(45) Date of Patent: Jul. 7, 2026

(54) METHOD FOR TOOL FACE ANGLE CONTROL FOR ROTARY STEERABLE DRILLING SYSTEM

(71) Applicant: Sylvain Bedouet, Houston, TX (US)

(72) Inventors: Sylvain Bedouet, Houston, TX (US); Karim Boudah, Katy, TX (US)

( * ) Notice: Subject to any disclaimer, the term of this patent is extended or adjusted under 35 U.S.C. 154(b) by 556 days.

(21) Appl. No.: 18/096,885

(22) Filed: Jan. 13, 2023

(65) Prior Publication Data

US 2024/0240525 A1 Jul. 18, 2024

(51) Int. Cl.

| | |
|---|---|
| ***E21B 7/06*** | (2006.01) |
| ***E21B 21/10*** | (2006.01) |
| ***E21B 44/00*** | (2006.01) |
| ***E21B 47/024*** | (2006.01) |

(52) U.S. Cl.

CPC ..... *E21B 7/068* (2013.01); *E21B 7/067* (2013.01); *E21B 21/10* (2013.01); *E21B 44/00* (2013.01); *E21B 47/024* (2013.01)

(58) Field of Classification Search

CPC ..... E21B 7/068; E21B 7/067; E21B 21/10; E21B 44/00; E21B 47/02

See application file for complete search history.

(56) References Cited

U.S. PATENT DOCUMENTS

| | | | | |
|---|---|---|---|---|
| 9,657,561 | B1 * | 5/2017 | Bargach | E21B 47/022 |
| 11,476,789 | B1 * | 10/2022 | Liu | H02P 27/085 |
| 2012/0169263 | A1 * | 7/2012 | Gallegos-Lopez | H02P 25/22 318/400.29 |
| 2016/0341027 | A1 * | 11/2016 | Kyllingstad | E21B 7/10 |
| 2017/0306739 | A1 * | 10/2017 | Ge | E21B 47/024 |
| 2017/0335670 | A1 * | 11/2017 | Dykstra | E21B 47/02 |
| 2021/0108503 | A1 * | 4/2021 | Neufeldt | E21B 7/04 |

FOREIGN PATENT DOCUMENTS

| | | | | |
|---|---|---|---|---|
| CA | 2700258 C | * | 11/2012 | E21B 7/10 |

* cited by examiner

*Primary Examiner* — Eman A Alkafawi
*Assistant Examiner* — Dilara Sultana
(74) *Attorney, Agent, or Firm* — Blair B. Suire

(57) ABSTRACT

A method for controlling the tool face angle of a rotary steerable system inside a well. The tool face angle is mainly controlled through the determination of the duty cycle of an AC Machine, producing its torque. The controlling duty cycle of the AC Machine is determined through the summing of a duty cycle set point with one or more duty cycle corrective values, using a Pulse Width Modulation technique. The duty cycle corrective values use different cut-off frequencies and update frequencies to accommodate the non-linearity and asymmetry of the system response. The method can also be used for controlling the angular rate of the rotary steerable system.

19 Claims, 9 Drawing Sheets

METHOD FOR TOOL FACE ANGLE CONTROL FOR ROTARY STEERABLE DRILLING SYSTEM

BACKGROUND

This disclosure relates generally to methods for the control of a directional well trajectory when using Rotary Steerable System or RSS. This disclosure relates more particularly to control methods of the tool face angle within the RSS.

Rotary Steerable Systems are commonly used with directional drilling operations to drill wellbores with specific trajectories and precise paths. As a common example of RSS, push-the-bit systems act on the drill bit axis of rotation by deflecting it away from the actual axis of the previously drilled wellbore. The deflection may be caused by actuators or pads located on the external cylindrical surface of the RSS at the proximity of the drill bit.

An RSS may be combined with other drill string components to enable drilling of downhole geological layers to reach zones of interest including oil, gas, water, hydrocarbons, or relevant mixtures. An enhanced control of the drilling trajectory within a desired path is key to maximize the value of the drilled well.

The control of the RSS may include the control of a tool face angle. The tool face angle can be defined as the angular position of internal components of the RSS along the main cylindrical axis of the drill string, using the ground as reference. Such internal components may include a control valve rotor and a sensor section. A typical control goal may be to keep the angular position of the control valve rotor or other internal components within a desired tool face angle while the external body of the RSS may be rotating. During drilling operations, the external body of the drill string may rotate, driven by a rotary table or a top drive located on the surface rig, or by a mud motor located above the RSS.

The proposed invention allows an enhanced control of the tool face angle to better adjust the well trajectory. An improved well trajectory may bring significant advantages, such as faster, more precise, and smoother movements of the drill string.

The invention is based on the combination of different digital pulses to control the torque produced by an Alternating-Current machine or AC machine. The AC machine may be used to produce the mechanical torque required to adjust the tool face angle of the RSS. This control technique may be also referred as "bang-bang control" allowing to accommodate the non-linearity and asymmetry of the response of the system, which may be caused for example by friction on bearings or solids present in drilling mud, or stick-slip of the control valve rotor.

BRIEF DESCRIPTION OF THE DRAWINGS

For a more detailed description of the embodiments of the disclosure, reference will now be made to the accompanying drawings.

FIG. 7A is an isometric cross-section view while FIG. 7B is a planar cross-section view, both perpendicular to the rotation axis.

11B is a flow-chart schematic for setting the AC Machine duty cycle through the summing of the target-RPM duty cycle set-point and corrections at different update frequencies.

Figure 12:
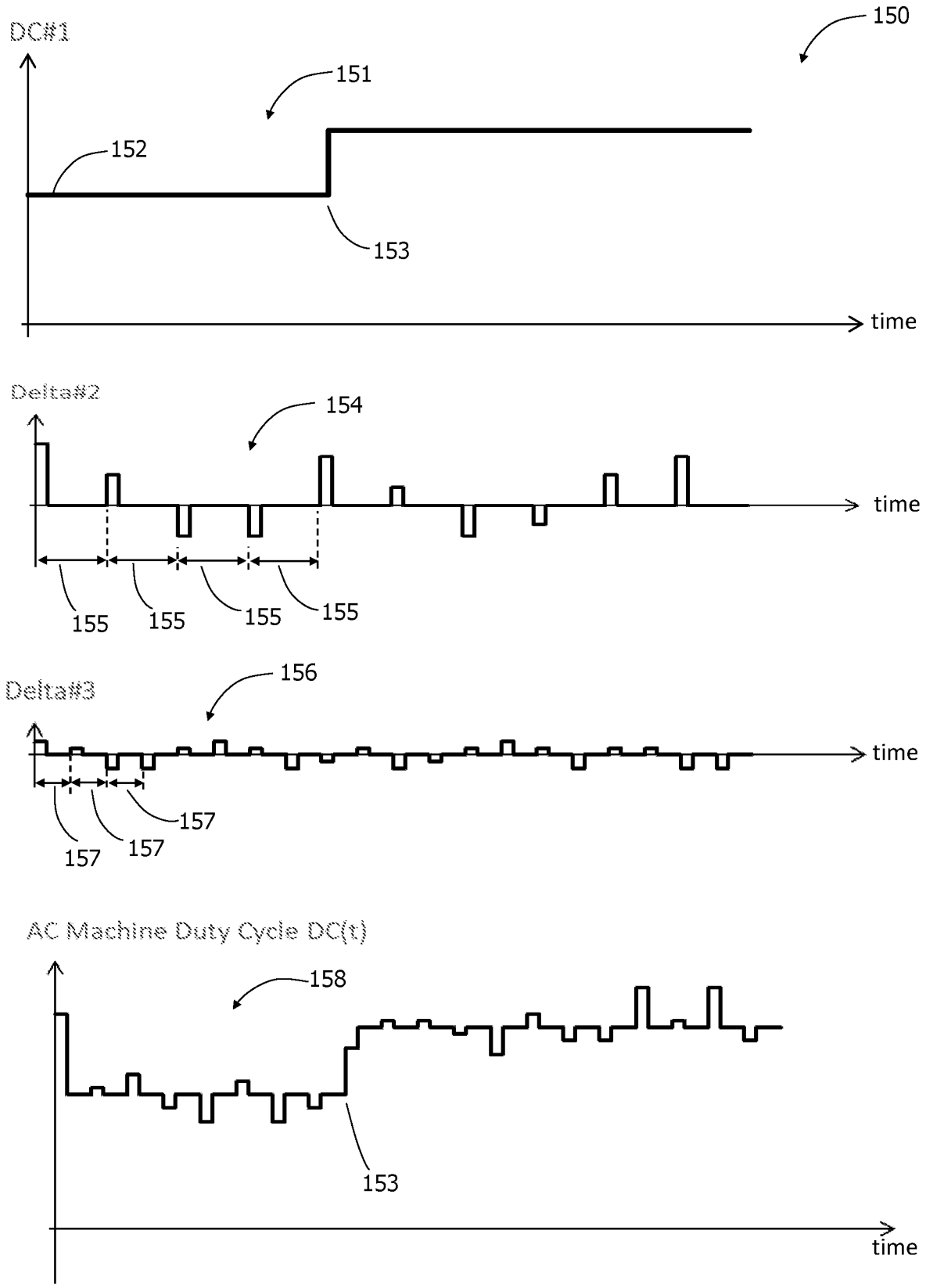

FIG. 12 is an illustration of the AC Machine duty cycle sum versus time.

Figure 13:
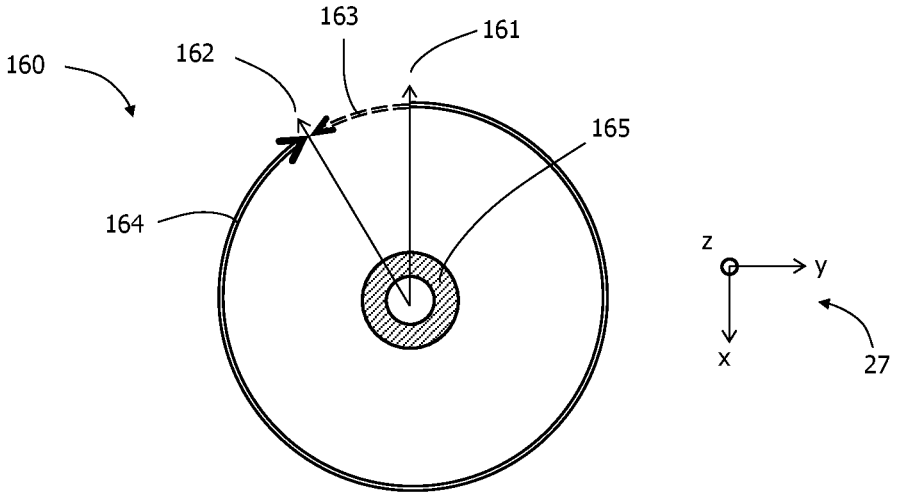

FIG. 13 is a schematic of the tool face angle control using a long path algorithm.

Figure 14:
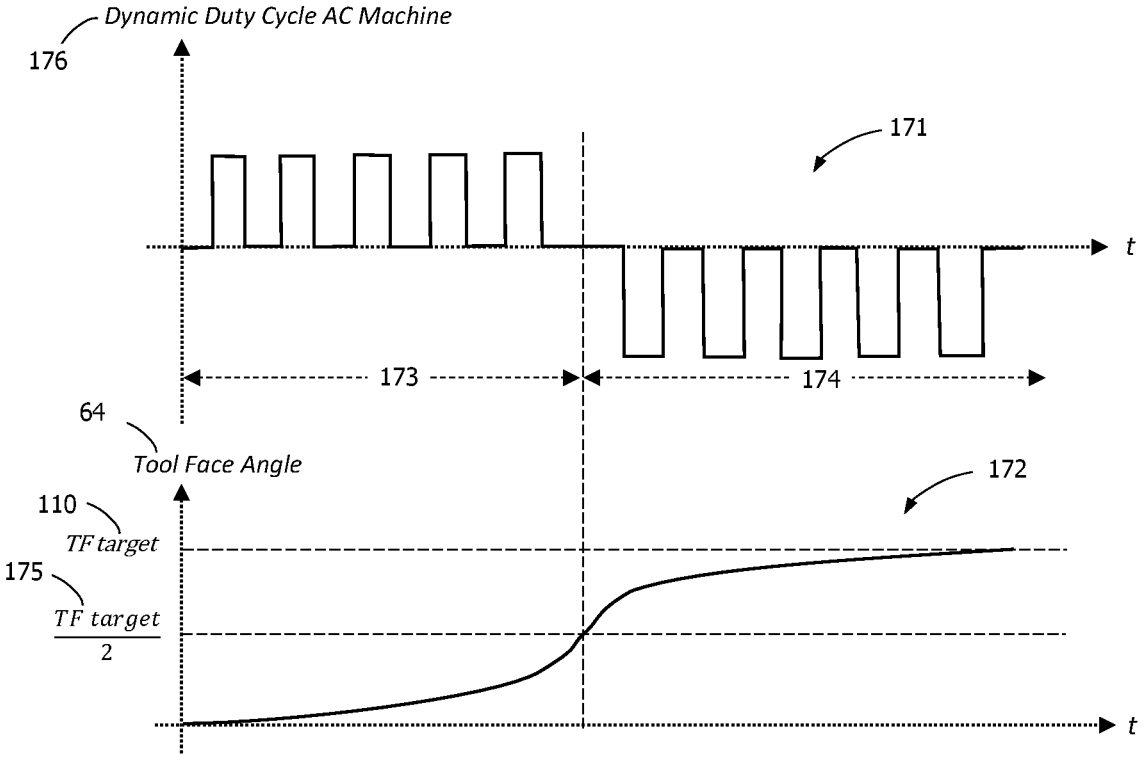

FIG. 14 is a time representation of a dynamic AC Machine duty cycle and possible outcome to the tool face angle as an S-curve.

DETAILED DESCRIPTION

It is to be understood that the following disclosure describes several exemplary embodiments for implementing different features, structures, or functions of the invention. Exemplary embodiments of components, arrangements, and configurations are described below to simplify the disclosure; however, these exemplary embodiments are provided merely as examples and are not intended to limit the scope of the invention.

Figure 1:
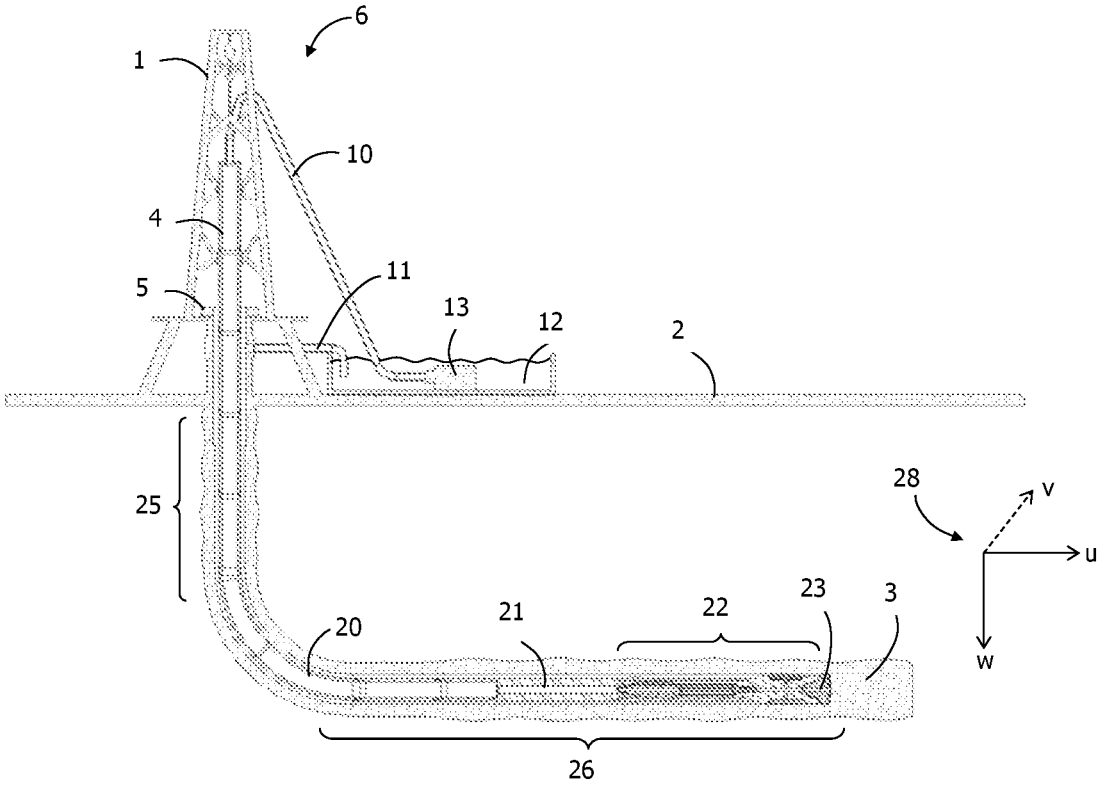
FIG. 1 is a wellbore and drilling rig cross-section view of typical drilling operation with an RSS.

FIG. 1 represents the schematic of a typical drilling operation. Above the rig floor surface 2, a drilling rig 6 may be present to drill downhole. The representation of FIG. 1 is typical for a land rig. The invention implementation may also and equally function for an offshore drilling rig. The presence of sea water below the rig floor surface 2 will not influence the function of the invention described thereafter.

Above the rig floor surface 2, a typical drilling rig 6 is represented. Among the key components, a derrick 1 will hold the rig structure including a top drive and drill pipes. Installed drill pipes are represented as item 4. Each additional drill pipe allows extending the overall drill string 20 to allow drilling inside the ground 3. The drill string 20 will typically rotate along its cylindrical axis thanks a rotary table 5. Also represented is the surface mud circulation system. The drilling mud will typically be stored inside a mud tank 12. A mud inflow pipe 10 will provide mud inside the drill pipe 4 and inside the overall drill string 20. The mud return will occur on the annulus between the external surface of drill string and inside the drilled well bore. The mud return pipe 11 directs the mud back to the mud tank 12. The mud pump 13 provides the flow power for the mud to circulate from surface to downhole, reaching the drill bit 23 and then back to surface.

Downhole inside the ground 3, a typical drill string 20 is represented. From the furthest point of the drill string 20, a drill bit 23 is present as the boring point inside the ground 3. Above the drill bit, a Rotary Steerable System (RSS) 22 may be present, which may be followed with a logging while drilling system (LWD), a measurement while drilling system (MWD) 21 and a mud motor (MM). The remaining of the drill string 20 is constituted by an assembly of drill pipes 4, which are connected one by one from surface.

A typical wellbore representation is depicted in FIG. 1 with a vertical section 25 followed by a horizontal section 26. Additional wellbore configurations are also possible. For example, the horizontal section may include multiple deviated sections resulting in a wellbore having multiple turns and directions. The drill string 20 may follow an intended trajectory and create a wellbore based on any direction within a 3-dimensional ground coordinate system u-v-w, as depicted in schematic 28.

Figure 2:
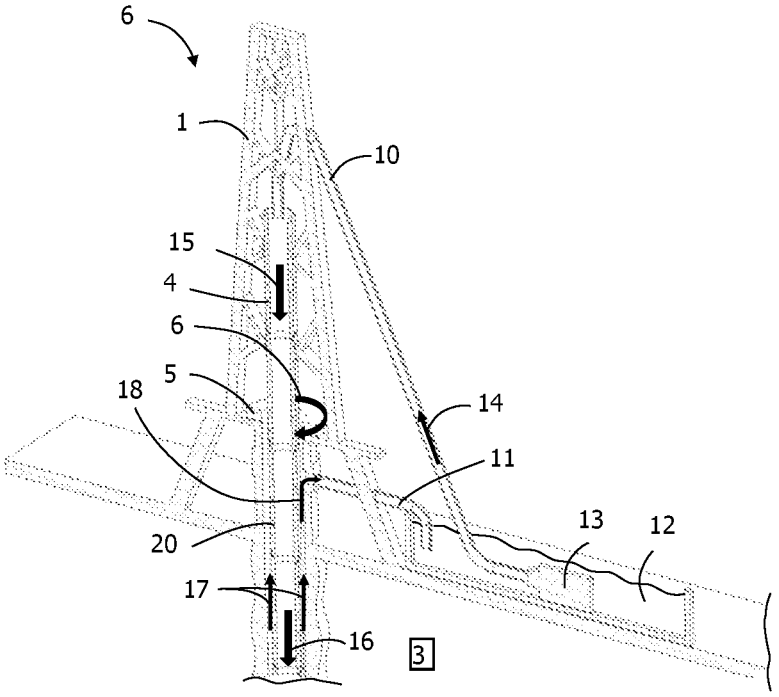
FIG. 2 is a drilling rig isometric cross-section view of the drill string movement and drilling mud circulation.

FIG. 2 represents a detailed view of the surface rig 6. The detailed view of FIG. 2 depicts the surface mud circulation. Surface mud circulation may influence the downhole mud circulation in the RSS, which will further be depicted in FIG. 3 to FIG. 7.

The drill string 20 is directed at surface by the derrick 1, typically including a top drive above the drill string. In continuous drilling operation, additional drill pipes 4 are connected, typically screwed one-by-one, on the existing drill string 20, extending the overall drill string and offering the possibility to drill deeper in the ground 3. Generally, a rotary table 5 or a top drive contributes to a rotation movement 6 of the drilling string 20. A downhole mud motor can also be added to the drill string to provide additional rotation movement. This movement is typically clockwise, if having a view from the rig towards downhole, or w direction, based on coordinate system 28.

The mud circulation is depicted from the mud tank 12, through the mud pump 13 and towards the mud inflow pipe 10. The mud movement is represented as the arrow 14 upwards inside the mud inflow pipe 10. The mud then circulates downwards inside the drill pipes 4 and overall drill string 20, which is represented with arrows 15 and 16. The mud circulates back, as depicted with arrows 17, through the anulus between the external surface of the drill string and the wellbore. Back to surface, the mud return flow is directed out of the bell nipple towards a radial direction 18. Then the mud circulates back to the mud tank 12 through a return pipe 11.

Figure 3:
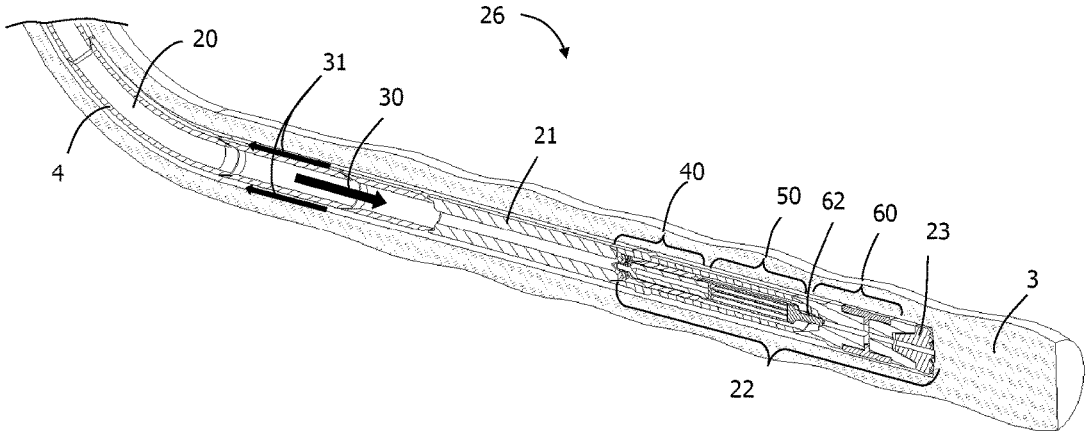
FIG. 3 is a wellbore isometric cross-section view of the end portion of the drill string including an RSS.

FIG. 3 represents a detailed view of the drilled wellbore horizontal section 26. The horizontal section 26 may include the end part of the drill string 20 within the ground 3. The drill string 20 may include a MWD system 21 and a LWD system. An RSS 22 may be connected to a LWD or MWD section 21. The RSS 22 may include an AC machine 40 powered by the mud flow, a sensor section 50, a mud flow controlling valve rotor 62, and a steering section 60. The steering section 60 may include piston pads which can be used to steer the drill string 20 towards the desired direction. The depicted figure represents what is commonly referred as "push-the-bit" system. The invention further described may as well be compatible with a "point-the-bit" system.

Mud flow 30 may travel within the internal cylindrical cavity of the drill string 20. The return flow 31 may travel on the outside surface of the drill string inside the drilled wellbore within the ground 3. Further details of mud flow within the RSS 22 will be depicted and described in FIG. 5.

Figure 4:
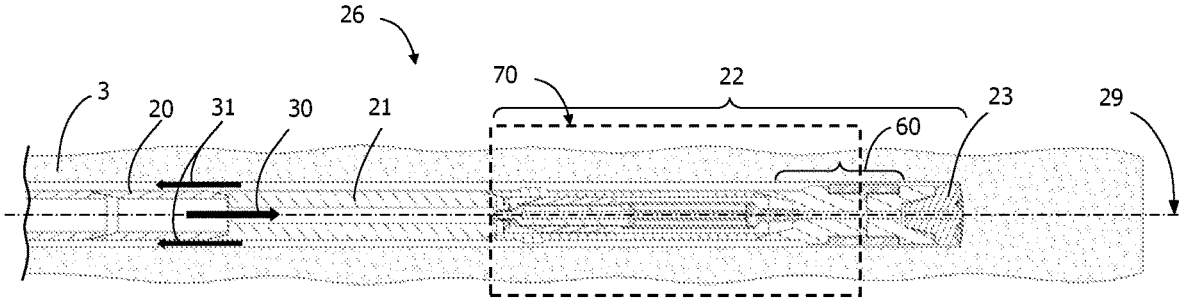
FIG. 4 is a wellbore cross-section view of the end portion of the drill string including an RSS along its rotation axis.
Figure 5:
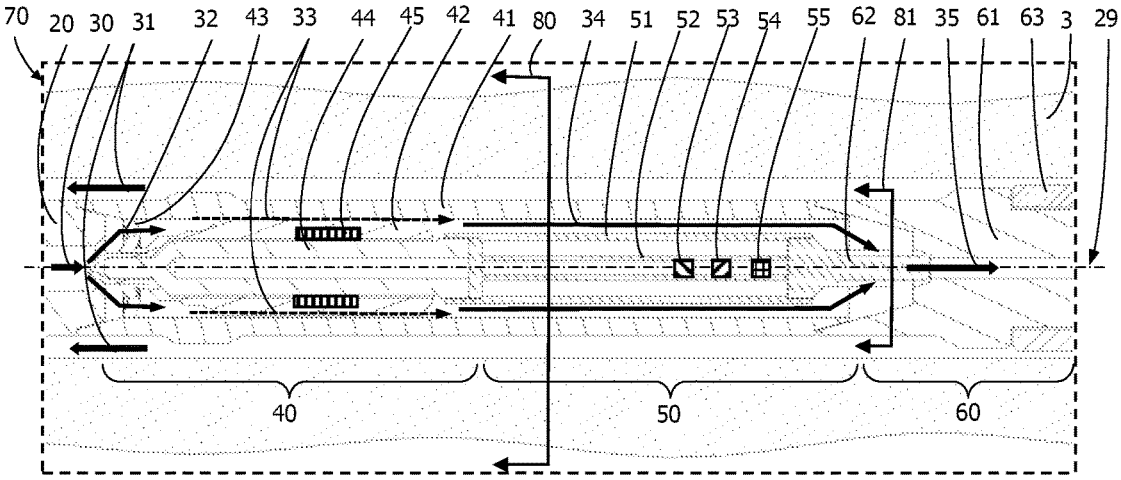
FIG. 5 is a wellbore cross-section view of a detailed portion of an RSS including mud flow paths within the different sections.

In other configurations, not depicted in FIG. 3-5, the AC machine 40 may be connected directly to the steering section 60 and to the mud flow controlling valve rotor 62. The sensor section 50 may therefore be disposed on the opposite direction and uphole of the AC machine 40.

FIG. 4 represents a detailed view of the drilled wellbore horizontal section 26 along the rotation axis 29. The cross-section view depicts the end portion of the drill string 20 within ground 3. An expanded selected area 70 will further be described in FIG. 5. The selected area 70 includes the key internal components of the RSS 22. The steering section 60 is depicted at the proximity of the drill bit 23. On the opposite direction of the drill bit 23, a LWD or MWD system 21 may be present to measure, record and transmit data to the surface while drilling. The measured data may be used for controlling the RSS, be transmitted back to surface through mud pulses, or recorded for further reference after retrieval of the drill string 20 at surface.

The drilling mud typically circulates downwards inside the center cavity of the drill string 20 following a flow path 30. After passing through the LWD and MWD system 21, then through the RSS 22 and finally through the drill bit, the drilling mud circulates back upwards on the external surface of the drill string, as represented by flow path 31.

FIG. 5 represents an expanded detailed view of area 70 as defined in FIG. 4. FIG. 5 is a cross-section view of the AC machine 40 and the sensor section 50 of the RSS 22, along the cylindrical rotation axis 29. The AC machine 40 of the RSS may include a stator unit 44 and a rotor unit 42. The rotor unit 42 may be mechanically linked to a turbine 43. The turbine 43 may rotate using the mud flow 32 diverted from the main mud flow 30 circulating inside the drill string 20 from surface. The AC machine 40 may provide electric power and mechanical torque to the RSS 22.

Figure 7A:
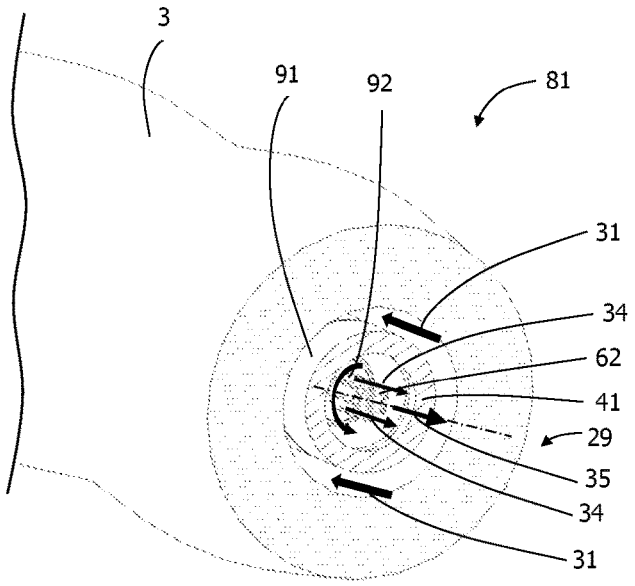
FIGS. 7A and 7B are cross-section views of the valve section.
Figure 7B:
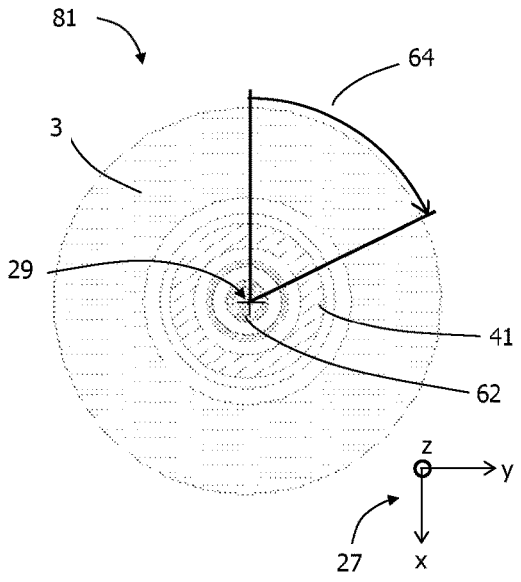

The control of the AC machine 40 may enable the production of the torque required to set the tool face angle 64, further described in FIG. 7B.

The sensor section 50 may be connected mechanically to the stator unit 44. The sensor section 50 may include various components able to measure, record and use data from in-situ sensors, such as one or more magnetometer 53, one or more rate sensor 54, and one or more accelerometer 55.

Figure 6:
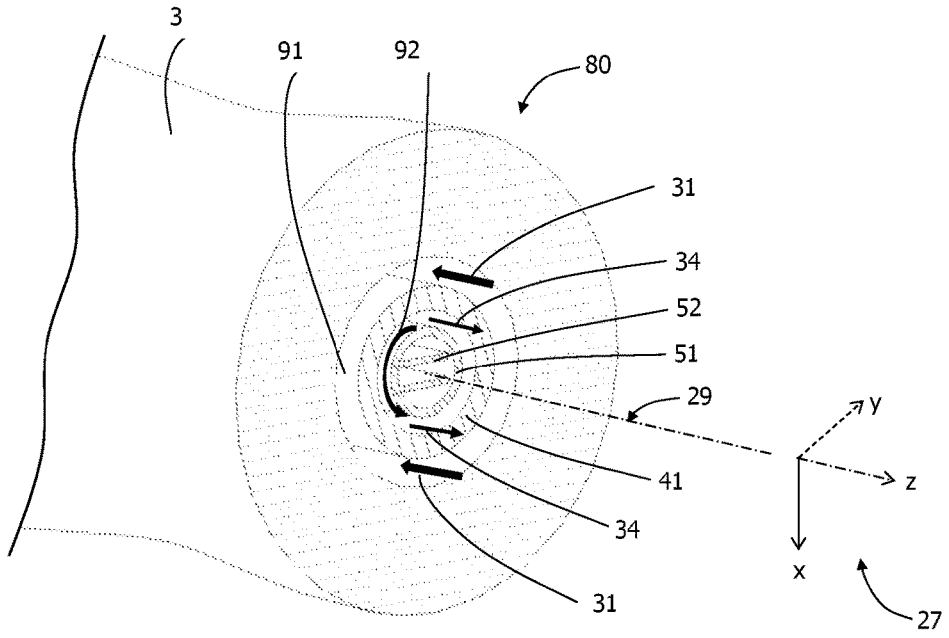
FIG. 6 is an isometric cross-section view of the sensor section, perpendicular to its rotation axis.

The magnetometers 53 may measure the actual angular position of the sensor section 50 relative to the earth magnetic field along multiple axis, such as x, y and z as displayed in the coordinate system 27 of FIG. 6. The presence of multiple magnetometers 53 within the sensor section 50 may allow to realize multiple measurements along the different axis.

The rate sensors 54, also designated as angular rate sensor, may measure actual rotation speed of the sensor section 50 relative to ground 3 as reference.

The accelerometers 55 may measure the angular position of the sensor section 50 relative to the earth gravity field along multiple axis, such as x, y and z, as displayed in the coordinate system 27 of FIG. 6. The presence of multiple accelerometers 55 within the sensor section 50 may allow to realize multiple measurements along the different axis.

An electronic section 52 may also include the control and command system for the AC machine 40, which in turn can provide a form of control for the steerable section 60.

The mud flow controlling valve rotor 62 may provide directional flow to the steerable pads 63. Output flow 35 from the mud flow controlling valve rotor 62 may depend on the angular orientation of the mud flow controlling valve rotor 62 relative to the ground 3 as reference Therefore, depending on the angular position of the mud flow controlling valve rotor 62 relative to the ground 3, the steering pads 63 may be extended radially at an angular position corresponding to the Tool Face angle, resulting in the control of the drilling direction of the drill string 20.

The position of two cross-sections 80 and 81 are depicted in FIG. 5 to provide further details for the relative movement of the different parts in the RSS 22. Cross-section 80 is depicted in FIG. 6, and cross-section 81 is depicted in FIGS. 7A and 7B.

FIG. 6 represents a cross-section view of the sensor section 50, along the plane 80, perpendicular to the cylindrical rotation axis 29. The plane reference 80 is also represented in FIG. 5.

The cross-section view of FIG. 6 depicts a drill collar 41, represented as a cylindrical shape. The drill collar 41 may be connected to the overall drill string 20, depicted in FIG. 1-5. As shown in FIG. 1 and FIG. 2, the drill string 20 may be typically driven in a rotational movement from surface. The rotation of the drill string 20 as well as the drill collar 41 is represented with an arrow 91. The rotation movement 91 generally occurs in a clockwise direction when observing the drill string 20 from surface towards the downhole direction, using the ground 3 as reference. In a coordinate system 27, linked to the RSS 22, symbolized with x-y-z axis, the rotation 91 may occur clockwise in the x-y plane when looking in the z direction.

The drilling mud may circulate downwards, down from surface, inside the RSS 22, within the drill collar 41 and outside the internal components housing 51, as symbolized with arrows 34. The drilling mud may circulate upwards, back to surface, outside the drill collar 41 and inside the drilled wellbore in the ground 3, as symbolized with arrows 31.

In drilling operation using the RSS 22, the rotation speed of the sensor section 50 along the rotation direction 29, using the ground 3 as reference, may be designated as angular rate 92, or sometimes roll rate. The actual angular rate 92 may therefore be defined as a rotational speed, typically using Rotation Per Minute or RPM as unit, of the sensor section 50, relative to a geostationary reference.

FIGS. 7A and 7B represent a cross-section view of the mud flow controlling valve rotor 62, along a plane 81 perpendicular to the cylindrical rotation axis 29. The plane reference 81 is also represented as cross-section in FIG. 5. FIG. 7A represents the cross-section view as an isometric view, cut at the plane 81. FIG. 7B represents only the cross-section at the plane 81, as a planar view.

The mud flow controlling valve rotor 62 may be mechanically linked to the sensor section 50, and therefore may rotate in the same direction 92 and same speed, or angular rate 92, as the sensor section 50, shown in FIG. 6. The drill collar 41 may be the same entity as the one depicted in FIG. 4 and FIG. 5, and therefore may rotate in the same direction 91 and speed as the drill string 20.

The drilling mud may circulate downwards, down from surface, inside the RSS 22, within the drill collar 41 and within the mud flow controlling valve rotor 62, as symbolized with arrows 34. The output flow through the mud flow controlling valve rotor 62 is represented with an arrow 35. The drilling mud may circulate upwards, back to surface, outside the drill collar 41 and within the drilled wellbore in the ground 3, as symbolized with arrows 31.

In FIG. 7B, the mud flow controlling valve rotor 62 may have an actual angular position relative to the vertical plane along the drill string axis. The angular position of the mud flow controlling valve rotor 62 is represented with angle 64. The angle 64 may be referred as tool face angle in some drilling operations, when referenced compared to the vertical plane x-z, using the coordinate system 27. As depicted, an actual tool face angle 64 may be defined within the x-y plane, using the coordinate system 27.

Control of the tool face angle 64 is directly linked to the mud flow controlling valve rotor 62 angular position and in turn with the drilling mud flow direction towards the steering section 60. Therefore, the tool face angle 64 control may determine the radial extension or retraction of the steering pads 63, as depicted in FIG. 5.

The invention focuses on controlling the tool face angle 64 to obtain an enhanced control of the drilling trajectory.

In other configurations, not depicted, the sensor section 50 may be connected with the drill collar 41 and decoupled from the mud flow controlling valve rotor 62. In this configuration, the AC motor 40 may be linked directly to the mud flow controlling valve rotor 62. In order to measure the angular rate 92 and the tool face angle 64 of the mud flow controlling valve rotor 62, relative to ground 3, an angular sensor, further referred as item 117 in FIG. 8B, such as a Hall-effect sensor, an encoder or resolver, may be added. The angular sensor 117 may measure an intermediate angular rate between the sensor section 50 and the mud flow controlling valve rotor 62, or between the sensor section 50 and the stator unit 44 of the AC machine 40. In this configuration the magnetometers 53, accelerometers 55 and rate sensors 54 of the sensor section 50 may be coupled with the drill collar 41. Therefore, the measurement of the angular rate 92 and of the tool face angle 64 may be realized with the combination of the sensing done by the sensor section 50 with the angular sensor 117.

Figure 8A:
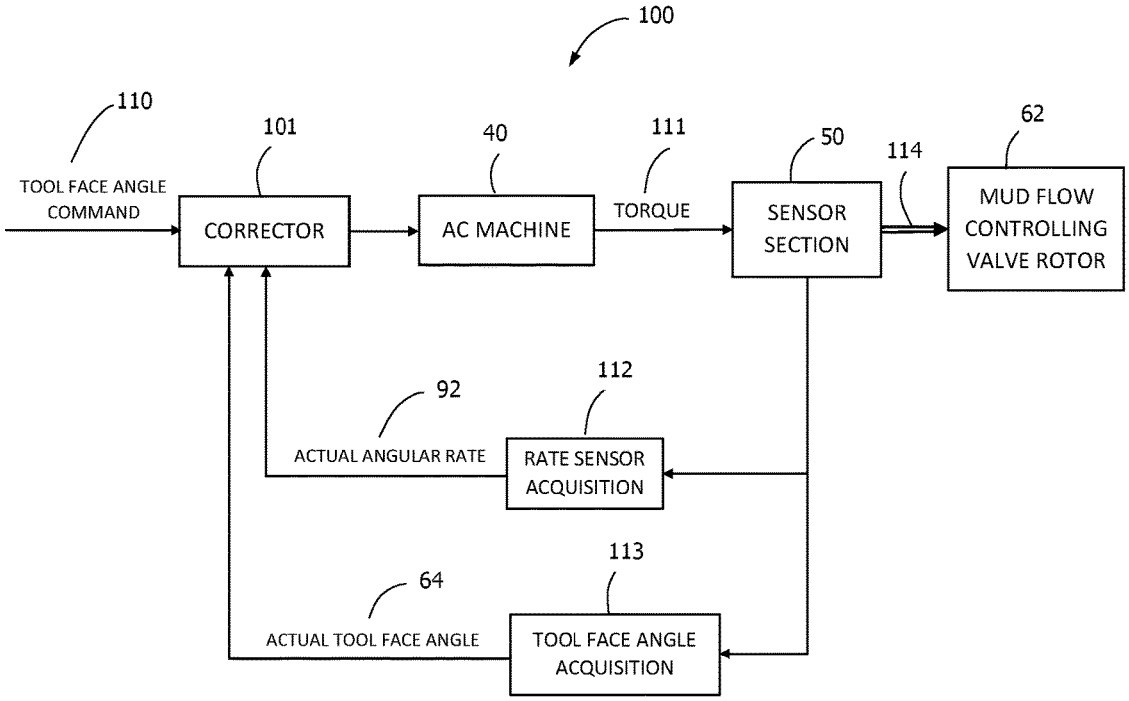
FIGS. 8A and 8B are schematics for the control loop of the tool face angle.

FIG. 8A represents a control loop schematic 100. The input of the control loop is the tool face angle command 110. The tool face angle command 110 may represent the command for the tool face angle 64, as defined in FIG. 7B. Controlling deviation between the tool face angle command 110 and the actual measured tool face angle 64 may be a key function for reaching a desired drilling direction.

Within the control loop 100, a corrector 101 may allow to control the AC machine 40. The corrector 101 includes the calculation of the AC machine duty cycle, which will be detailed in FIG. 9 and FIG. 10. The corrector 101 may allow calculating an angular rate error and several tool face errors. The angular rate error may be defined as the difference between the angular rate command, and the actual angular rate 92. The angular rate command may be a zero-RPM rate command 108, as further depicted in box 123 of FIG. 9A, or may be a target-RPM rate command 125, as further depicted in box 126 of FIG. 9B. The tool face errors may be defined as the difference between the tool face angle command 110 and the actual tool face angle 64, filtered at a predetermined frequency. The filtered cut-off frequencies for the tool face errors are introduced in box 132 and 133 of FIG. 10.

The AC machine 40 relates to the description done in FIG. 5, the control of the torque 111 produced between the stator unit 44 and the rotor unit 42 may have a direct impact on actual tool face angle 64.

The mechanical output of the AC machine 40 may be influenced by frictions and the rotation of the turbine 43, as described in FIG. 5. The frictions relate typically to rotation friction within the RSS. As depicted in FIG. 5, several parts may be rotating, sometimes in opposite directions, generally surrounded by drilling mud. For example, depending on drilling mud viscosity, temperature, solids presence, bearing contacts, the rotation of the internal parts of the RSS may be affected by friction.

The sensor section 50 may contribute to determine the actual angular rate 92 and actual tool face angle 64, through a combination of measurements with one or more magnetometers 53, one or more rate sensors 54 and one or more accelerometers 55. The output of the sensor section 50 may be processed by a rate sensor acquisition 112 to obtain the actual angular rate 92, and may be processed by a tool face angle sensors acquisition 113 to obtain the actual tool face angle 64. The sensor section 50 may be linked mechanically with the mud flow controlling valve rotor 62, through a coupling 114. In this configuration, both the sensor section 50 and the mud flow controlling valve rotor 62 may have the same actual angular rate 92 and same actual tool face angle 64.

Figure 8B:
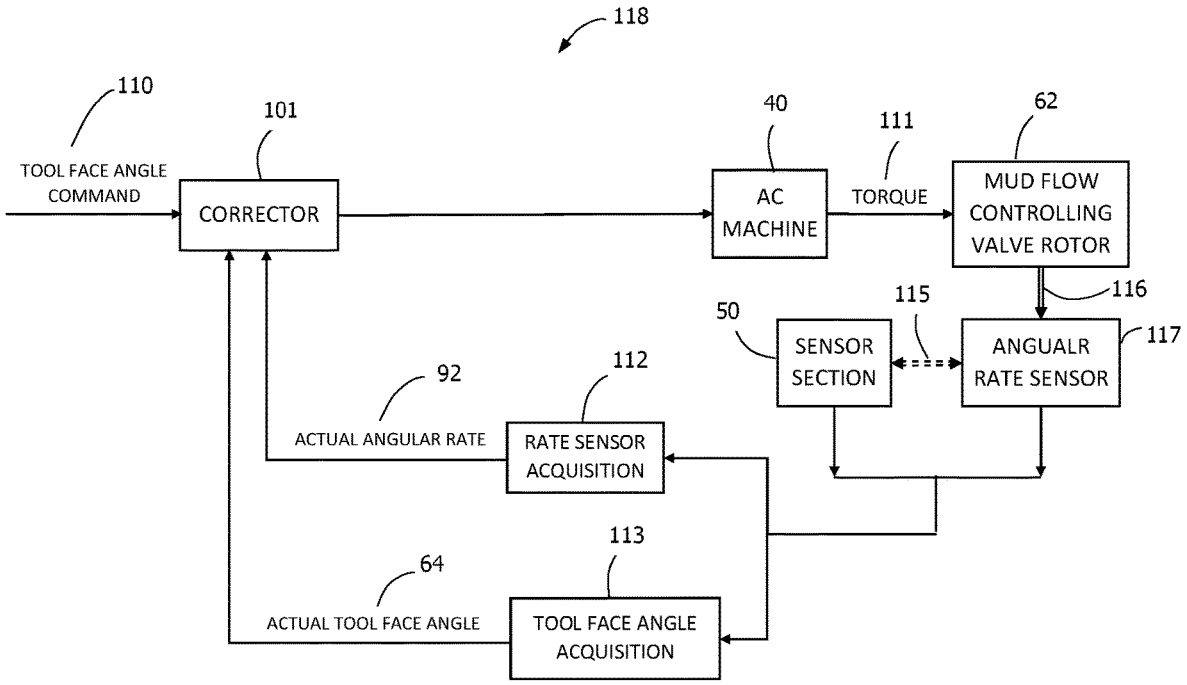

FIG. 8B represents a variation from FIG. 8A. In this configuration, the sensor section 50 may be coupled with the drill collar, decoupled from the AC Machine 40, and linked to an angular rate sensor 117. The angular rate sensor 117, such as a Hall-effect sensor, an encoder or resolver, may be positioned between the sensor section 50 and the mud flow controlling valve rotor 62. Depending on the configuration of the angular rate sensor 117, the angular rate sensor 117 may have two portions, a first portion being linked to the sensor section 50, and second portion coupled to the mud flow controlling valve rotor 62 with coupling 116. The link 115 between the two portions of the angular rate sensor 117 may be contact-less. The AC Machine 40 controls the torque 111, which has a direct mechanical impact on the mud flow controlling valve rotor 62. The angular rate sensor 117 may influence the measurements done by the decoupled sensor section 50, and the combined measurements may be used as input for the rate sensor acquisition 112 and tool face angle acquisition 113. The other items or steps depicted in FIG. 8B may function the same way as described in FIG. 8A.

Figure 9A:
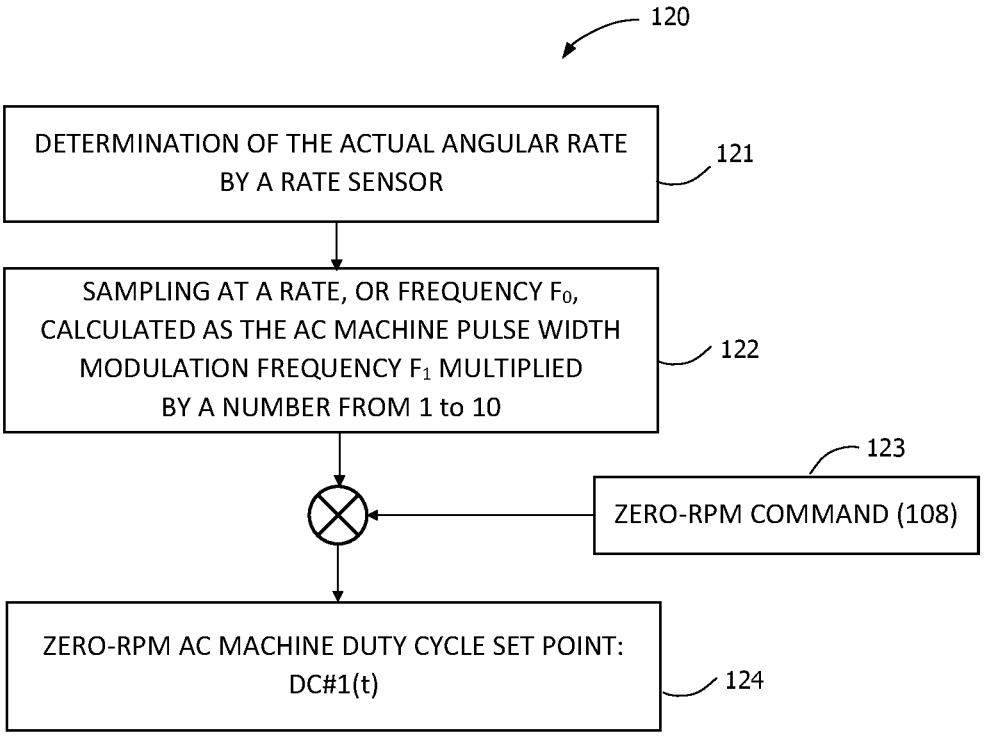
FIG. 9A is a flow-chart schematic for setting the zero-RPM duty cycle set point.

FIG. 9A represents the angular rate control flowchart 120. The angular rate has been defined with item 92 in FIG. 6 for the actual angular rate measured. Introduced is the zero-RPM command as item 108, further described in step 123. The control of the actual angular rate 92 to a command 108 as close as possible to 0 RPM may be required to enable the control of the tool face angle 64.

Step 121 corresponds to the actual measurement of the angular rate 92 by the rate sensor 54, placed as depicted in FIG. 5.

Step 122 corresponds to the sampling of the rate sensor measurement at frequency $F_0$, calculated from the AC machine Pulse Width Modulation frequency, or $F_1$, multiplied by a number comprised between 1 and 10.

Step 123 corresponds to the command of an angular rate 108 to be 0 RPM. The goal may be to eliminate the measured angular rate 92, and therefore having the mud flow controlling valve rotor 62, as defined in FIG. 5, to be geostationary compared to the ground 3.

Step 124 corresponds to the duty cycle set point DC#1(t) required to reach a zero-RPM command 108. DC#1(t) corresponds to the duty cycle driving the AC machine 40 in order to eliminate the measured angular rate 92. The duty cycle represents the ratio of on-time versus total cycle time, when closing (on-time) and opening (off-time) the connection of the windings of the AC machine 40 to an electrical load.

Figure 9B:
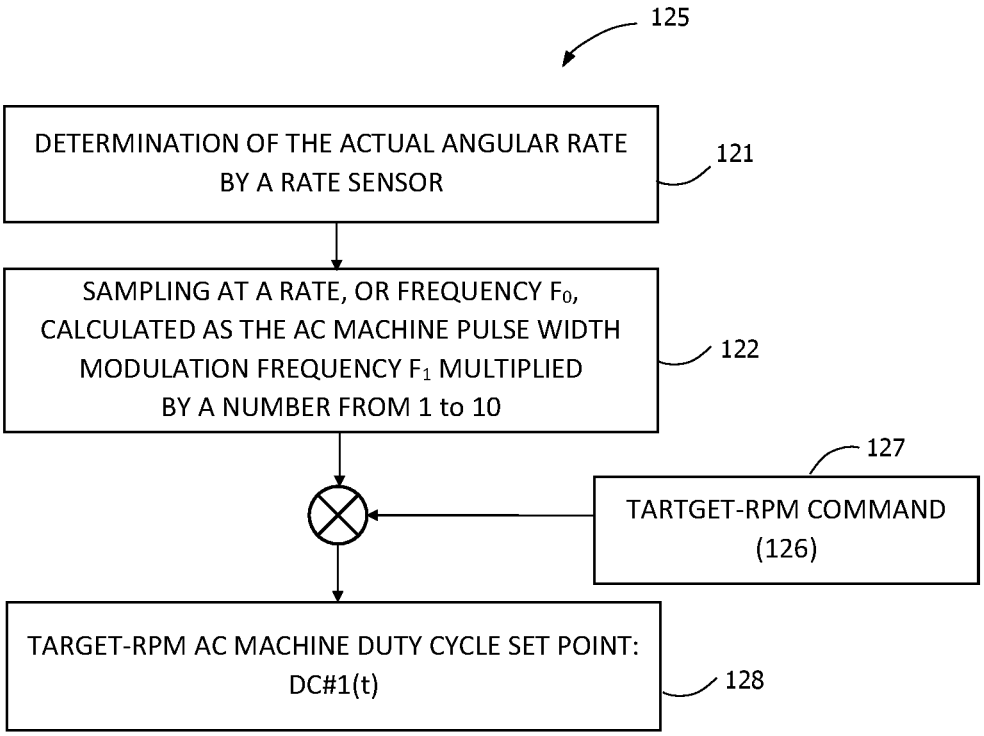
FIG. 9B is a flow-chart schematic for setting the target-RPM duty cycle set point.

FIG. 9B represents a variation of FIG. 9A. FIG. 9B depicts another angular rate control flowchart 125. In this configuration, Step 127 corresponds to the command of an angular rate 126, as a target RPM or desired RPM. A target-RPM value may for example be between 2 and 50 RPM. Further, Step 128 corresponds to the duty cycle DC#1(t) driving the AC machine 40 in order to reach the target-RPM command. The other items or steps depicted in FIG. 9B may function the same way as described in FIG. 9A.

Figure 10:
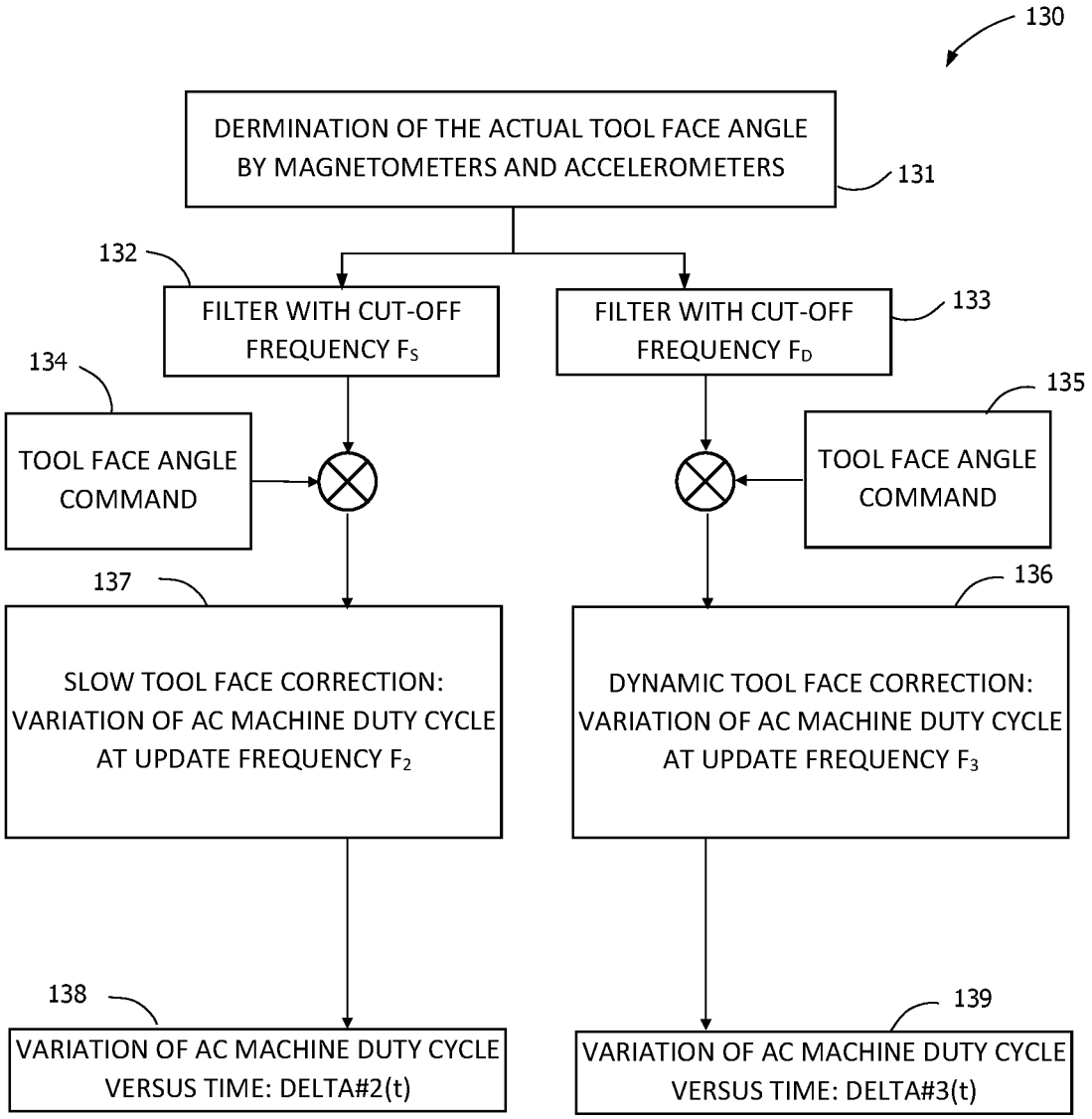
FIG. 10 is a flow-chart schematic for correcting the tool face angle.

FIG. 10 represents the tool face angle control flowchart. The tool face angle command has been defined as item 110 in FIG. 8, and the actual or measured tool face angle as item 64 in FIG. 7B.

Step 131 corresponds to the measurement of the actual tool face angle 64 by combined sensing from the magnetometers 53 and accelerometers 55. The magnetometer 53 and accelerometer 55 are detailed in FIG. 5.

Two steps 132 and 133 may occur in parallel. The two steps 132 and 133 may use the actual tool face 64 measurement signal and may filter the signal through two different frequencies. A cut-off frequency $F_S$ may be used in step 132 to filter the signal of measurement 64. Another cut-off frequency $F_D$ may be used in step 133 to filter the signal of measurement 64.

Step 134 represents the command of the tool face angle 110. Step 135 also represents the command of the tool face angle 110. The command of the tool face angle 110 will be compared to the actual tool face angle 64 measured.

Step 136 represents the control of the dynamic drift or correction of the tool face angle 64. For the dynamic tool face angle drift correction, the AC machine duty cycle may be updated at a frequency $F_3$.

Step 137 represents the control of the slow drift of the tool face angle. For slow tool face angle drift correction, the AC machine duty cycle update frequency F2 is set as the dynamic tool face update frequency F3 divided by a number comprised between 2 and 200.

Step 138 represents the calculation of the AC machine duty cycle slow correction versus time, designated as DELTA#2(t).

Step 139 represents the calculation of the AC machine duty cycle dynamic correction versus time, designated as DELTA#3(t).

Figure 11A:
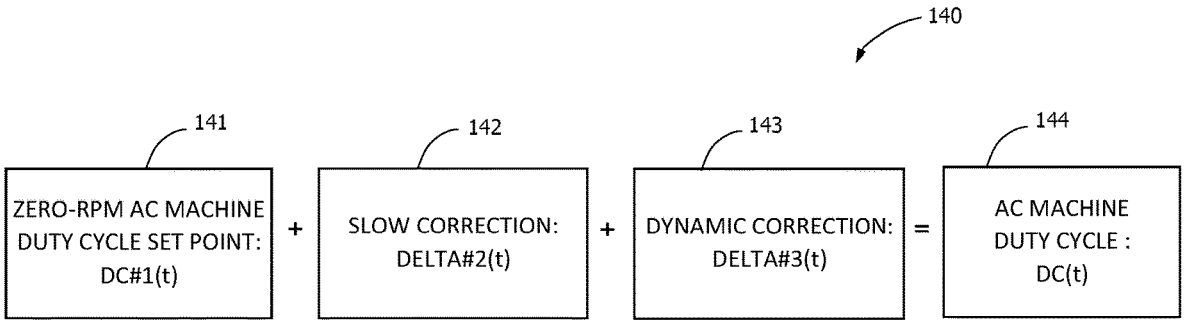
FIG. 11A is a flow-chart schematic for setting the AC Machine duty cycle through the summing of the zero-RPM duty cycle set-point and corrections at different update frequencies.

FIG. 11A represents a flowchart 140 for the calculation of the AC Machine Duty Cycle over time or DC(t), as shown in box 144. The AC Machine Duty cycle DC(t) 144 may be the result of the sum of the zero-RPM AC Machine duty cycle set point with a slow and a dynamic correction, previously calculated. Box 141 depicts DC#1(t), or the zero-RPM AC Machine duty cycle set point, calculated in step 124 of FIG. 9A. Box 142 depicts the PMW duty cycle slow correction or DELTA#2(t), calculated in step 138 of FIG. 10. Box 143 depicts the PWM duty cycle dynamic correction or DELTA#3(t), calculated in step 139 of FIG. 10.

The summing of three PWM duty cycles updates (Zero-RPM AC Machine duty cycle set point, slow correction and dynamic correction) allows to capture a large variety of situations and variations, and therefore allows to correct at higher speed and precision the actual tool face angle 64 based on the tool face angle command 110, than would a standard PID or Proportional-Integral-Derivative.

Figure 11B:
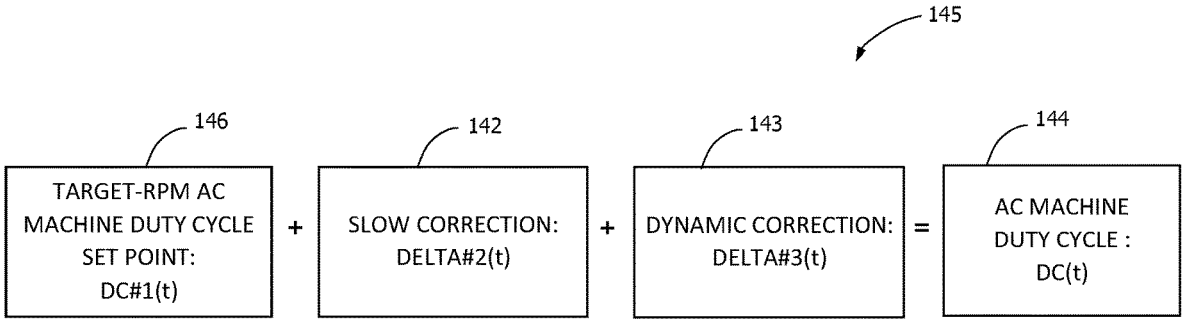

FIG. 11B represents a variation of FIG. 11A and depicts a flowchart 145. The AC Machine Duty cycle DC(t) 144 may be the result of the sum of the predetermined-RPM AC Machine duty cycle set point with a slow and a dynamic correction, previously calculated. Box 146 depicts DC#1(t), or the predetermined-RPM AC Machine duty cycle set point, calculated in step 128 of FIG. 9B. The other items or steps depicted in FIG. 11B may function the same way as described in FIG. 11A.

FIG. 12 represents time diagram examples 150, showing the summing of the zero-RPM PWM Duty Cycle set point, along with the two corrections, resulting in the AC Machine Duty Cycle DC(t), as introduced in FIG. 11.

Graph 151 depicts a time plot example representing DC#1(t) described as item 141 in FIG. 11A or item 146 in FIG. 11B. The plot may typically be constant with a value 152 representing the zero-RPM or target-RPM AC Machine Duty Cycle set point, as explained in FIG. 9A with box 124 or in FIG. 9B with box 128. The zero-RPM or target-RPM AC Machine Duty Cycle set point value 152 may not change as long as the conditions influencing the mechanical output of the AC machine are not changing. As an example, a change in the zero-RPM or target AC Machine Duty Cycle set point value 152 may occur at an event 153. The event 153 may represent for example a change in the rotation speed of the turbine 43, or an overspeed detected by the sensor section 50.

Graph 154 depicts a time plot example representing Delta#2(t) or the slow correction, described as item 142 in FIG. 11A or 11B. The plot may typically represent digital pulses over time, which may occur at a time period 155. The time period 155 corresponds to the inverse of the update frequency $F_2$ as described in box 137 of FIG. 10. Digital pulses of graph 154 corresponds to the slow tool face correction or Delta#2(t), previously described in box 138 of FIG. 10. Digital pulses may have a width of a fraction of a second and heights varying with the calculated correction from the corrector 101, depicted in the flowchart of FIG. 8A or 8B.

Graph 156 depicts a time plot example representing Delta#3(t) or the dynamic correction, described as item 143 in FIG. 11A or 11B. The plot may typically represent pulses over time, which may occur at a time period 157. The time period 157 corresponds to the inverse of the update frequency $F_3$ as described in box 136 of FIG. 10. Pulses of graph 156 corresponds to the dynamic tool face correction or Delta#3(t), previously described in box 139 of FIG. 10.

Graph 158 depicts a time plot example representing DC(t) or AC Machine Duty Cycle, described as item 144 in FIG. 11A or 11B. The graph 158 represents the summing over time of DC#1(t) from graph 152, with Delta#2(t) from graph 154 and Delta#3(t) from graph 156.

FIG. 13 represents an improvement for the control of the tool face angle 64, in situation of high duty cycle set points. Represented in FIG. 13 is a schematic 160 which relates to the FIG. 7B with the definition of the measured or actual tool face angle 64. The schematic 160 represents a section view in the x-y plane of the RSS reference 165.

An actual tool face angle 161 may be present. As an example, the actual tool face angle direction 161 may be aligned with the opposite x-axis, as depicted on the coordinate system 27. A desired tool face angle direction 162 may be a desired target. As depicted the angular displacement 163 from the actual tool face direction 161 to the desired tool face angle direction 162 may be around 20 degrees. Reaching the desired tool face angle direction 162 via the angular displacement 163, as the shortest path, may require an excessive torque, translating into a high duty cycle. To increase the operating range of the system while reducing stress on the AC machine 40 and electronics section 52, as depicted in FIG. 5, a control method using a longer angular displacement 164 may be used.

FIG. 14 represents an S-curve to reach a desired tool face angle. In order to reach the targeted tool face angle 110, several accelerations and decelerations may be necessary. Accelerations 173 and decelerations 174 are depicted in the schematic 171 versus time as digital pulses to correct the dynamic AC Machine duty cycle 176. The accelerations 173 are represented as positive pulses and decelerations 174 are represented as negative pulses. The corresponding update of the actual tool face angle 64 is represented in a graph 172, concurrently with graph 171. During the acceleration phase 173, the actual tool face angle 64 evolves towards its target value of the desired tool face value 110. Typically, the fastest variations of the tool face angle 64 occurs around the inflection point, noted "TF target/a" or mid value 175. The proportion "a" may typically be a number around 2, within a range of 1.25 to 4. During the acceleration phase 173, the actual tool face angle 64 may reach the mid value 175 in a faster way, mathematically with a positive second derivative, then during the deceleration phase 174, the tool face angle 64 may reach the target value 110 in a slower way, mathematically with a negative second derivate. The goal of the control and regulation may be for the actual tool face angle 64 to reach the target value 110 as fast as possible, while being precise without overshooting the target value.

What is claimed is:

1. A method for controlling a duty cycle for an AC Machine within a drilling tool, comprising:

determining an actual angular rate and an actual tool face angle of a mud flow controlling valve rotor, relative to a geostationary reference, whereby the mud flow controlling valve rotor is actuated by the AC machine;

controlling the electrical current passing in a winding of the AC machine through a Pulse-Width-Modulation technique, whereby the Pulse-Width-Modulation technique includes determining a regulating duty cycle for the AC machine;

calculating an angular rate error, whereby the angular rate error represents the difference between a target-RPM angular rate command and the actual angular rate of the mud flow controlling valve rotor, determining a duty cycle set point for the AC machine to reduce the calculated angular rate error;

calculating a first tool face error, including:

filtering a signal of the actual tool face angle through a first cut-off frequency, and calculating the difference between a tool face angle command and the actual tool face angle filtered at the first cut-off frequency;

determining a first correction to reduce the first tool face error, whereby the first correction includes calculating a first duty cycle corrective value for the AC machine, updated at a third frequency;

calculating a second tool face error, including:

filtering the signal of the actual tool face angle through a second cut-off frequency, wherein the second cut-off frequency is different from the first cut-off frequency, and calculating the difference between the tool face angle command and the actual tool face angle filtered at the second cut-off frequency;

determining a second correction to reduce the second tool face error, whereby the second correction includes calculating a second duty cycle corrective value for the AC machine, updated at a fourth frequency;

whereby the third frequency is set at a value lower than the fourth frequency;

summing the determined duty cycle set point, the calculated first duty cycle corrective value, and the calculated second duty cycle corrective value to obtain the regulating duty cycle for the AC machine.

2. The method of claim 1, further comprising:
determining an actual angular position of the mud flow controlling valve rotor, relative to a geostationary reference,
whereby the actual tool face angle is determined from the actual angular position of the mud flow controlling valve rotor.

3. The method of claim 2, whereby the mud flow controlling valve rotor is mechanically coupled to a sensor section.

4. The method of claim 3,
whereby the sensor section includes one or more angular rate sensor, one or more magnetometers, and one or more accelerometers,
wherein the one or more angular rate sensor, the one or more magnetometers, and the one or more accelerometers of the sensor section provide signals in order to determine the actual angular rate and the actual angular position of the mud flow controlling valve rotor.

5. The method of claim 2, whereby the AC machine is mechanically coupled in rotation with a sensor section.

6. The method of claim 5,
whereby the sensor section is mechanically decoupled in rotation with the mud flow controlling valve rotor,
whereby the sensor section includes one or more angular rate sensor, one or more magnetometers, and one or more accelerometers,
whereby the mud flow controlling valve rotor includes or is linked to an angular position sensor,
wherein the one or more angular rate sensor, the one or more magnetometers, the one or more accelerometers of the sensor section, combined with the angular position sensor of the mud flow controlling valve, provide signals in order to determine the actual angular rate and the actual angular position of the mud flow controlling valve rotor.

7. The method of claim 4, whereby the signals of the sensor section are processed through at least one digital controller.

8. The method of claim 2,
whereby the regulating duty cycle for the AC machine allows driving a torque of the AC machine,
whereby the torque of the AC machine controls the actual angular rate and the actual angular position of the mud flow controlling valve rotor.

9. The method of claim 2, whereby determining the regulating duty cycle for the AC machine includes adjusting an amplitude and a duration of digital pulses through the Pulse-Width-Modulation technique.

10. The method of claim 2, further comprising:
controlling steering pads,
whereby the control of the steering pads occurs through controlling the angular position of the mud flow controlling valve rotor,
whereby controlling the steering pads includes a radial extension or retraction of the steering pads,
whereby controlling the steering pads influences a trajectory within a well for the drilling tool.

11. The method of claim 2 further comprising:
updating the duty cycle set point for the AC machine,
whereby the update of the duty cycle set point for the AC machine includes:
detecting when the angular rate exceeds set limits over a period of time, correcting the duty cycle set point for the AC machine.

12. A method for controlling a tool face angle of a drilling tool, comprising:
determining an actual angular rate and an actual angular position of a mud flow controlling valve rotor, relative to a geostationary reference,
whereby the tool face angle is determined from the actual angular position of the mud flow controlling valve rotor,
whereby the mud flow controlling valve rotor is actuated by an AC machine,
whereby the AC machine includes a winding adapted to pass an electrical current;
controlling the electrical current in the winding of the AC machine through a Pulse-Width-Modulation technique,
whereby the Pulse-Width-Modulation technique includes determining a regulating duty cycle for the AC machine;
calculating an angular rate error,
whereby the angular rate error represents the difference between a zero-RPM angular rate command and the actual angular rate of the mud flow controlling valve rotor;
determining a duty cycle set point for the AC machine to eliminate the calculated angular rate error;
calculating a first tool face error,
whereby the first tool face error represents the difference between a tool face angle command and the actual tool face angle, filtered at a first frequency;
calculating a second tool face error,
whereby the second tool face error represents the difference between the tool face angle command and the actual tool face angle, filtered at a second frequency, wherein the second frequency is different from the first frequency;
determining a first correction to reduce the first calculated tool face error,
whereby the first correction includes calculating a first duty cycle corrective value, updated at a third frequency;
determining a second correction to reduce the second calculated tool face error,
whereby the second correction includes calculating a second duty cycle corrective value, updated at a fourth frequency,
whereby the third frequency is set at a value lower than the fourth frequency;
summing the determined duty cycle set point with the calculated first and second duty cycle corrective values, to determine the regulating duty cycle for the AC machine.

13. A method for controlling a tool face angle of a drilling tool, comprising:
determining an actual angular rate and an actual angular position of a mud flow controlling valve rotor, relative to a geostationary reference,
whereby the tool face angle is determined from the actual angular position of the mud flow controlling valve rotor,
whereby the mud flow controlling valve rotor is actuated by an AC machine,
whereby the AC machine includes a winding adapted to pass an electrical current;
controlling the electrical current in the winding of the AC machine through a Pulse-Width-Modulation technique,
whereby the Pulse-Width-Modulation technique includes determining a regulating duty cycle for the AC machine;

calculating an angular rate error, whereby the angular rate error represents the difference between a zero-RPM angular rate command and the actual angular rate of the mud flow controlling valve rotor;

determining a duty cycle set point for the AC machine to eliminate the calculated angular rate error;

calculating a first tool face error, whereby the first tool face error represents the difference between a tool face angle command and the actual tool face angle, filtered at a first frequency;

calculating a second tool face error, whereby the second tool face error represents the difference between the tool face angle command and the actual tool face angle, filtered at a second frequency;

determining a first correction to reduce the first calculated tool face error, whereby the first correction includes calculating a first duty cycle corrective value, updated at a third frequency;

determining a second correction to reduce the second calculated tool face error, whereby the second correction includes calculating a second duty cycle corrective value, updated at a fourth frequency, whereby the third frequency is set at the value of the fourth frequency divided by a value comprised between 2 and 200;

summing the determined duty cycle set point with the calculated first and second duty cycle corrective values, to determine the regulating duty cycle for the AC machine.

14. The method of claim 13, whereby the mud flow controlling valve rotor is mechanically coupled to a sensor section.

15. The method of claim 14, whereby the sensor section includes one or more angular rate sensor, one or more magnetometers, and one or more accelerometers, wherein the one or more angular rate sensor, the one or more magnetometers, and the one or more accelerometers of the sensor section provide signals in order to determine the actual angular rate and the actual angular position of the mud flow controlling valve rotor.

16. The method of claim 13, whereby the AC machine is mechanically coupled in rotation with a sensor section.

17. The method of claim 16, whereby the sensor section is mechanically decoupled in rotation with the mud flow controlling valve rotor, whereby the sensor section includes one or more angular rate sensor, one or more magnetometers, and one or more accelerometers;

whereby the mud flow controlling valve rotor includes or is linked to an angular position sensor, wherein the one or more angular rate sensor, the one or more magnetometers, the one or more accelerometers of the sensor section, combined with the angular position sensor of the mud flow controlling valve rotor, provide signals in order to determine the actual angular rate and the actual angular position of the mud flow controlling valve rotor.

18. The method of claim 16, whereby the regulating duty cycle for the AC machine allows driving a torque of the AC machine, whereby the torque of the AC machine controls the actual angular rate and the actual angular position of the mud flow controlling valve rotor.

19. The method of claim 16, further comprising:

controlling steering pads, whereby the control of the steering pads occurs through controlling the angular position of the mud flow controlling valve rotor, whereby controlling the steering pads includes a radial extension or retraction of the steering pads, whereby controlling the steering pads influences a trajectory within a well for the drilling tool.

* * * * *